US009664349B1

(12) United States Patent
Hurduc et al.

(10) Patent No.: US 9,664,349 B1
(45) Date of Patent: May 30, 2017

(54) ARTIFICIAL CANDLE WITH FLAME SIMULATOR

(71) Applicant: NII NORTHERN INTERNATIONAL INC., Vancouver (CA)

(72) Inventors: Lucian Hurduc, Ste-Julie (CA); Carl Marinier, Sainte-Catherine (CA); Pierre-Marc Tardy, Notre-Dame-de-l'ile-Perrot (CA)

(73) Assignee: NII NORTHERN INTERNATIONAL INC., Vancouver (CA)

( * ) Notice: Subject to any disclaimer, the term of this patent is extended or adjusted under 35 U.S.C. 154(b) by 0 days.

(21) Appl. No.: 15/405,810

(22) Filed: Jan. 13, 2017

Related U.S. Application Data

(60) Provisional application No. 62/278,119, filed on Jan. 13, 2016.

(51) Int. Cl.

| | |
|---|---|
| ***H01F 7/00*** | (2006.01) |
| ***F21S 10/04*** | (2006.01) |
| ***F21S 6/00*** | (2006.01) |
| ***F21V 14/06*** | (2006.01) |
| ***F21V 5/04*** | (2006.01) |
| ***F21V 9/08*** | (2006.01) |
| ***H05B 33/08*** | (2006.01) |
| ***F21S 9/02*** | (2006.01) |
| ***H01F 7/06*** | (2006.01) |
| ***H01F 5/00*** | (2006.01) |
| *F21Y 115/10* | (2016.01) |

(52) U.S. Cl.

CPC ..... *F21S 10/046* (2013.01); *F21S 6/001* (2013.01); *F21S 9/02* (2013.01); *F21V 5/04* (2013.01); *F21V 9/08* (2013.01); *F21V 14/06* (2013.01); *H01F 5/003* (2013.01); *H01F 7/064* (2013.01); *H05B 33/0845* (2013.01); *H05B 33/0863* (2013.01); *F21Y 2115/10* (2016.08)

(58) Field of Classification Search

None

See application file for complete search history.

(56) References Cited

U.S. PATENT DOCUMENTS

| | | | | |
|---|---|---|---|---|
| 2011/0127914 | A1* | 6/2011 | Patton | F21S 10/04 315/76 |
| 2014/0211499 | A1 | 7/2014 | Fong | |
| 2015/0036348 | A1* | 2/2015 | Dong | F21S 6/001 362/293 |
| 2015/0192283 | A1 | 7/2015 | Chien | |

(Continued)

*Primary Examiner* — Britt D Hanley

(74) *Attorney, Agent, or Firm* — McAndrews, Held & Malloy, Ltd.

(57) ABSTRACT

A flameless candle includes: a candle body; a projection screen; a supporting portion; a moving portion; an LED; and a magnetic-field-inducing circuit. The projection screen extends upwardly from an upper surface of the candle body, has a flame shape, and has a fixed position with respect to the upper surface of the candle body. The moving portion is supported by the supporting portion and includes: a transparent lens oriented diagonally; an arm extending downwardly; and a magnet on the arm. The LED is oriented to project light upwardly and diagonally such that the projected light travels through the lens, through an aperture of the upper surface of the candle body, and onto an outer surface of the projection screen. The magnetic-field-inducing circuit includes a coil that successively attracts and repels the magnet.

20 Claims, 5 Drawing Sheets

(56) References Cited

U.S. PATENT DOCUMENTS

| | | | | |
|---|---|---|---|---|
| 2015/0204530 | A1 | 7/2015 | Lee | |
| 2015/0308643 | A1* | 10/2015 | Huang | F21S 10/046 362/157 |
| 2015/0354769 | A1 | 12/2015 | Patton | |
| 2016/0040844 | A1* | 2/2016 | Patton | F21S 6/001 362/362 |
| 2016/0116127 | A1* | 4/2016 | Patton | F21S 6/001 362/284 |
| 2017/0038020 | A1* | 2/2017 | Patton | F21S 10/046 |

* cited by examiner

ARTIFICIAL CANDLE WITH FLAME SIMULATOR

CROSS REFERENCE TO RELATED APPLICATIONS

This application claims priority to U.S. Prov. Pat. Appl. No. 62/278,119, filed on Jan. 13, 2016, the entirety of which is herein incorporated by reference.

BACKGROUND

Generally, this application relates to flameless candles and, in particular, to creating the illusion of a flickering flame on a projection screen.

Flameless candles may provide an illusion of a real (flamed) candle, but without the risk of fire damage. A real candle flame moves in physical space. In order to simulate such movement, some have used an element or part that projects above an upper surface of the candle moves in physical space. A light from underneath the upper surface is projected onto such a moving element, and as it moves around, an illusion of a flame is created.

This approach has several problems. For example, a moving element protruding outside of the candle body may tend to become damaged such as during shipping, by mishandling, or by unintentional events. Furthermore, while the moving, protruding element may provide an effective illusion from a farther distance (for example, to a viewer six feet or farther away from the candle), the illusion becomes less effective or ineffective at closer distances. This is because the movement of the protruding element becomes apparent to the viewer, thereby leading to an artificial appearance.

Another drawback is that a relatively large amount of energy may be required to move a bulky, protruding element. This may lead to relatively quicker drainage of batteries (if used). Yet another problem is the lack of a wick. A flame without a wick on a candle is incongruent to a viewer. But if a wick is added to the protruding element, the wick would also move around, which is unnatural.

Another problem with existing, moving part candles is that the protruding element is part of a pendulum, and that pendulum may be driven in an overly aggressive and/or predictable manner. For example, some existing candles apply a force (by magnetic means) at regular intervals to the pendulum and then remove the force. Natural, gravity-driven oscillation will then move the pendulum back in the opposite direction. This movement may not have sufficient randomness to make an effective illusion. Additionally, the oscillation period of the pendulum may be relatively faster than the "pushing" period (when the force is applied), thereby causing an irregular and overly aggressive effect.

Yet another problem with these types of existing candles is that the intensity of the light does not vary, and therefore there is no flickering effect emanating from inside the translucent body of the candle. This detracts from the illusion, because a viewer would expect a flickering effect both on the flame itself and from the translucent body of the candle.

Another problem with existing, moving part candles is that the moving part may make contact with other parts of the candle, thereby making a sound that is uncharacteristic of a conventional, flamed candle.

SUMMARY

According to certain inventive techniques, a flameless candle includes: a candle body, a projection screen, a supporting portion, a moving portion, a lens, and light-emitting diode; and a magnetic-field-inducing circuit. The candle body includes a base, an upper surface having an aperture, and a translucent sidewall extending between the base and the upper surface. The candle body forms a hollow interior region. The projection screen extends upwardly from the upper surface of the candle body. The projection screen has a flame shape and has a fixed position with respect to the upper surface of the candle body. The supporting portion is located within the hollow interior region of the candle body. The moving portion is also located within the hollow interior region and it is supported by the supporting portion. The moving portion includes: a transparent lens oriented diagonally; an arm extending downwardly; and a magnet on the arm. The light-emitting diode (LED) is also located within the hollow interior region. The LED is oriented to project light upwardly and diagonally such that the projected light travels from the LED, through the lens, through the aperture of the upper surface of the candle body, and onto an outer surface of the projection screen. The LED is also separated by a distance from the lens. The circuit includes a coil arranged to alternately generate a magnetic field having a first polarity and a magnetic field having a second polarity, such that the magnet in the moving portion is successively attracted to the coil and repelled by the coil.

The supporting portion may have a tapered edge on its top surface. The supporting portion may include a U-shape or a V-shape. The projected light emitted by the LED may vary in intensity over time, such that the projected light flickers. A power of the projected light may vary by no more than approximately 25% from the average power as measured in lumens, such that the maximum power is no more than approximately 125% of the average power and the minimum power is no less than approximately 75% of the average power. The moving portion may include an intermediate portion connected to the lens and the arm, and the intermediate portion may rest on the supporting portion. The lens (for example, a substantially round lens) may have three degrees of freedom when the intermediate portion rests on the supporting portion. The outer surface of the projection screen may include a convex, concave, irregular, or flat surface facing the projected light. The coil may be energized more than 50% of the time when the moving portion is in motion. The projection screen may include an appearance of a wick (for example, a hole in the projection screen that is shaped like a wick or a region that is colored to look like a wick). The lens may have a colored region (for example, blue) and an uncolored region.

The flameless candle may further include an module positioned primarily within the hollow interior region, wherein the module houses the supporting portion, the moving portion, and the LED. The module may also house the coil.

Figure 2:
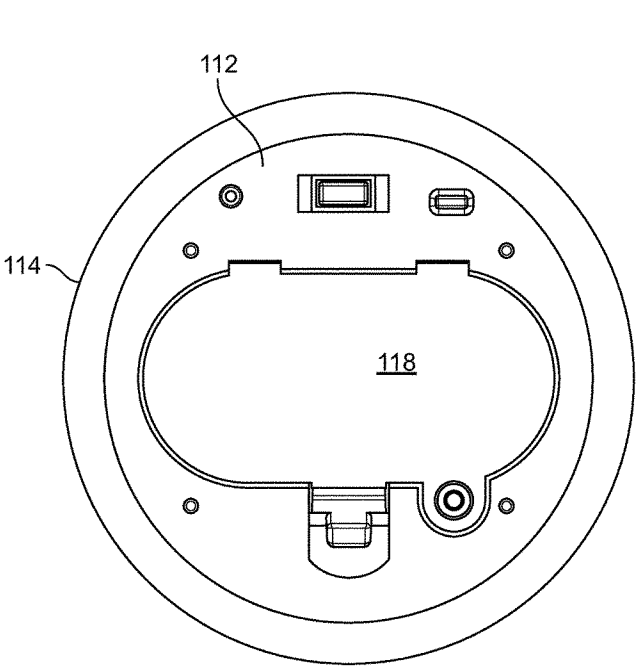
FIG. 2 illustrate a bottom view of the flameless candle, according to certain inventive techniques.
Figure 1:
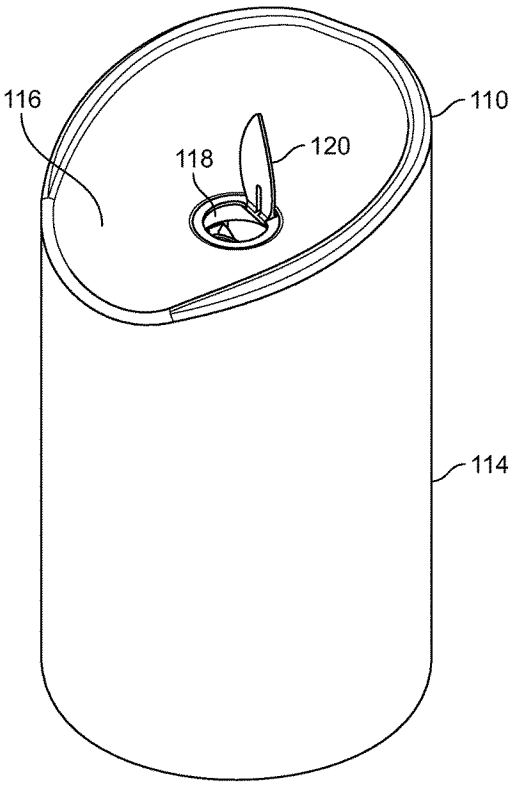
FIG. 1 illustrate a perspective view of a flameless candle, according to certain inventive techniques.

The foregoing summary, as well as the following detailed description of certain techniques of the present application, will be better understood when read in conjunction with the appended drawings. For the purposes of illustration, certain techniques are shown in the drawings. It should be understood, however, that the claims are not limited to the arrangements and instrumentality shown in the attached drawings. Furthermore, the appearance shown in the drawings is one of many ornamental appearances that can be employed to achieve the stated functions of the system.

DETAILED DESCRIPTION

As will be further described, the techniques disclosed herein solve the aforementioned problems. For example, instead of having a moving, protruding element, a static element is used. The static element is solidly connected to the candle body and/or other structures that are anchored to or connected to the candle body. This creates a much more durable, damage-resistant arrangement. As another example, by having a static screen, the illusion of a candle is improved, because a user is not distracted by a relatively large protruding part moving around.

Instead of moving a protruding element, a moveable portion including a lens interposed between a light source and a projection screen. The moving portion is underneath the upper surface of the candle body, thereby protecting it from inadvertent damage. The moving portion may be lighter and smaller than a projection screen, thereby requiring less power to move it. Additionally, because of the geometry of the system, it may not be required to move the moving portion as much (as compared to required movement of the protruding, moving screen), also leading to a reduction in power consumption.

Because the projection screen is static, a depiction of a wick (for example, paint or a hole) can be added to the screen, thereby creating the illusion of a static wick.

Furthermore, to overcome the issues of overly aggressive and unnatural pendulum movement, the moving portion including the lens can be successively pushed and pulled (rather than pushed and let gravity take over). By pushing and pulling the moving portion, a more natural, even, and less aggressive movement may be achieved.

Other problems have been solved by varying the intensity of the light source to create a flickering illusion from inside the candle body, and by providing a bumper on the moving portion to reduce or eliminate any perceptible sound from the candle.

FIGS. 1-5 illustrate different views of a flameless candle 100, according to certain inventive techniques. The flameless candle 100 includes a candle body 110 and a projection screen 120. The candle body 110 may have a base 112, an upper surface 116, and a sidewall 114 extending between the base and the upper surface 116. The candle body 110 may form a hollow interior region. The candle 100 may resemble a pillar candle (as shown), a taper candle, a votive, a tea light, other decorative candles, or the like. The candle body 110 may be translucent or include translucent regions. The translucence may be chosen so as to give the flameless candle 100 the appearance of a conventional candle. Specifically, when light from a light source within the candle body 110 emanates through the sidewall it may appear diffuse and have the character of light from a conventional candle. The candle body 110 may be formed of wax or plastic or other suitable material. When the candle body 110 is not formed of wax, it may include a waxen surface (for example, dipped in wax) to give the feel and translucent quality of real wax.

The upper surface 116 may include a concave recess (when viewed from above) to give the candle body 110 the appearance that the candle 100 has been used and some wax has been consumed by flame. The upper recess 116 may include an aperture 118. The aperture 118 may be located substantially along a primary axis in a vertical dimension of the candle body 110. The aperture 118 may allow light to pass from within the hollow interior region of the candle body 110 onto the projection screen.

The upper surface 116 may have a variety of different shapes. For example, the upper surface 116 may be shaped like a bowl or a portion of a bowl. Or, the upper surface 116 may include a flat bottom surface. The upper region of the sidewall 114 may have a varying height around the top perimeter of the candle 100. As depicted, the upper surface 116 may form a backdrop whereby the rim of the upper surface 116 is higher in the back of the candle body 110 than it is in the front.

The projection screen 120 may be adjacent to, proximate to, and/or extend upwardly from (or through) the aperture 118 in the upper surface 116. The projection screen 120 may be offset with respect to or positioned off of a primary axis along a vertical dimension at which the aperture 118 is located. The position of the projection screen 120 may be fixed with respect to the upper surface 116. Of course, an undue amount of force could cause the projection screen 120 to deflect or otherwise change position with respect to the upper surface 116. However, an anticipated movement of the electronic candle 100 (for example, picking up or putting down the candle, rotating the candle, or turning the candle upside down) may not influence the position of the projection screen 120 with respect to the upper surface 116.

Alternatively, the projection screen 120 may move with respect to the upper surface 116 by mechanical (for example, springs, wind, etc.) or electro-magnetic means.

The projection screen 120 may have a flame shape as depicted. The projection screen 120 may have two outer surfaces (front and back, as depicted), or three or more outer surfaces. When viewed from the front, the front outer surface may be convex, concave, flat, or irregular (for example, a mix of convex, concave, and/or flat regions). The projection screen 120 may include a portion or region that imitates a wick. Such a portion or region may be a painted region, a recessed region, or an aperture (i.e., a hole through the projection screen 120). The projection screen may be textured, smooth, opaque, and/or translucent. According to one technique, the translucency of the projection screen 120 is selected such that an illusion of a flame appears on both the front and rear outer surfaces.

The projection screen 120 may have different translucencies and/or textures on the front and back of the exterior surfaces of the projection screen 120. Also, different regions on the same surfaces may have different translucencies, textures, and/or thicknesses.

The candle 100 may include various components in addition to the candle body 110 and the projection screen 120, such as: a projection screen substructure 122 attached to the projection screen 120; a moving portion 130; a supporting portion 140 that supports the moving portion 130; a light source 150 (for example, one or more LEDs); a module housing 160, including a light source securing portion 162; and an electromagnet and control circuitry 170. The aforementioned components may be included in a module 190. For example, the electromagnet and control circuitry 170 may be located within or outside of the module housing 160. The assembled module 190 may be inserted through the underside of the candle body 110 and seated into the aperture 118 of the upper surface 116. The candle 100 may also include a battery compartment 180, batteries 182 (for example, two "C" batteries as depicted), and a battery door 184. These components may be located, at least partially or substantially, within the hollow interior region of the candle body 110.

Figure 3:
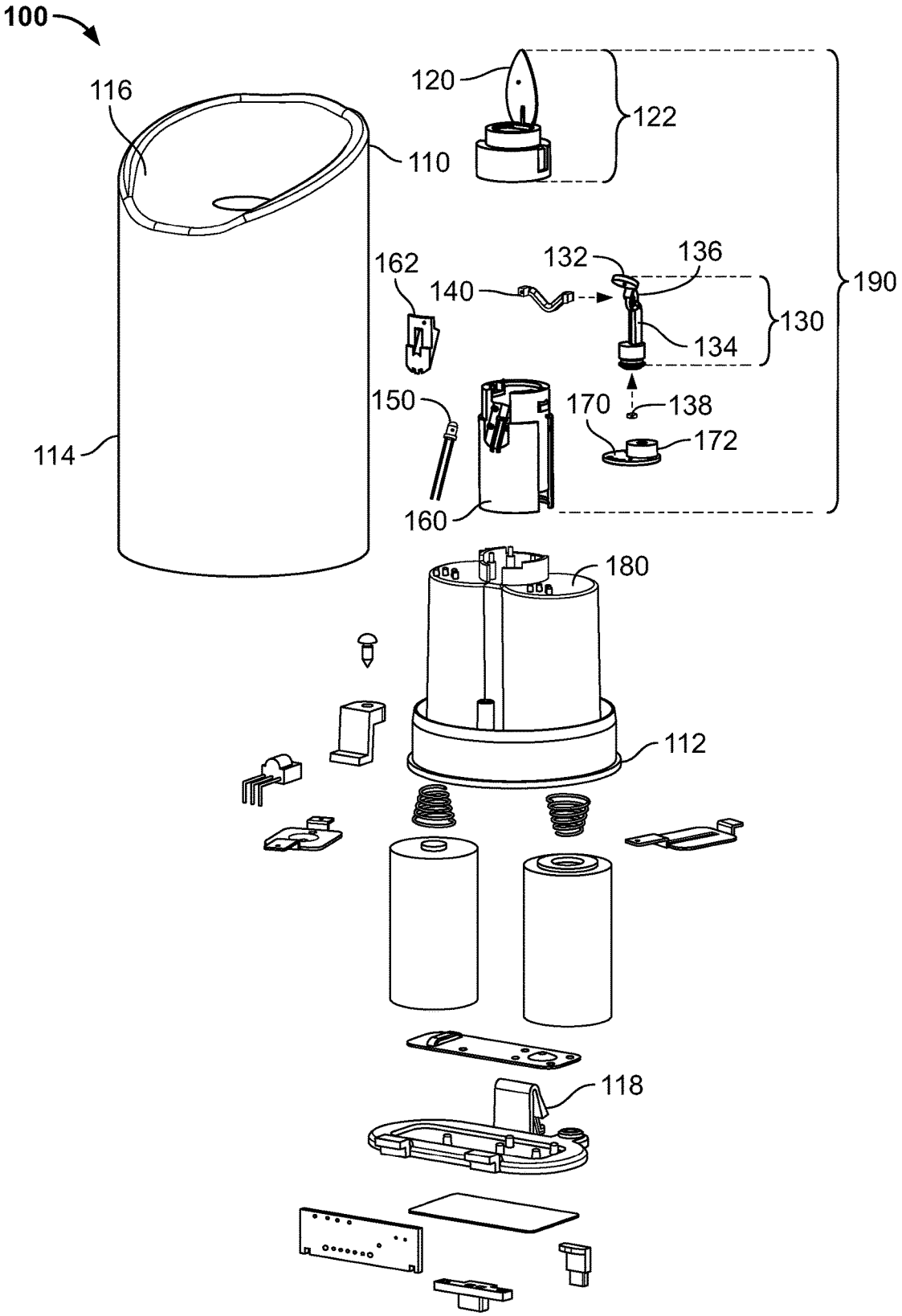
FIG. 3 illustrates an exploded view of the flameless candle, according to certain inventive techniques.
Figure 4:
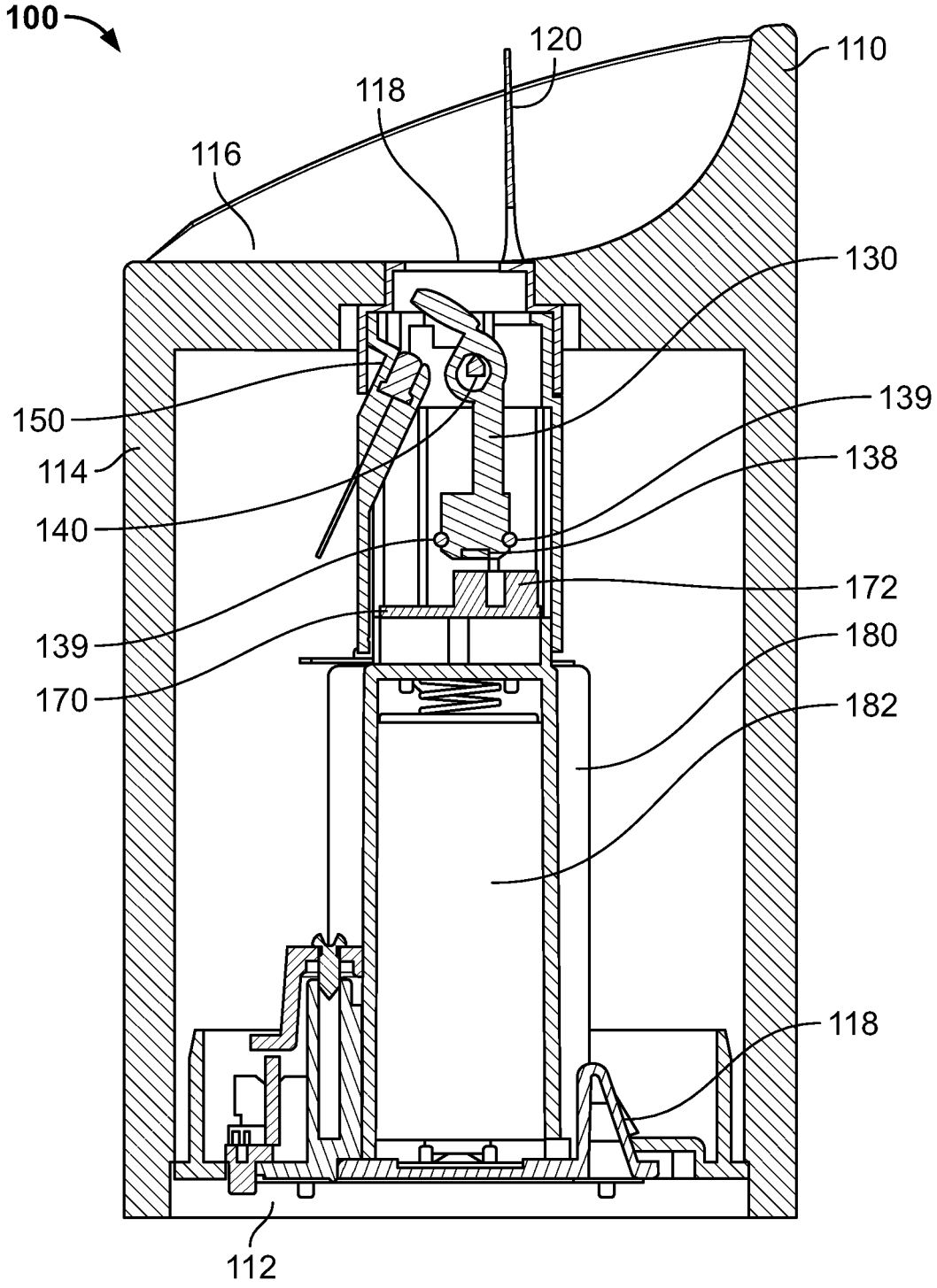
FIG. 4 illustrates a cross-sectional view of the flameless candle, according to certain inventive techniques.
Figure 5:
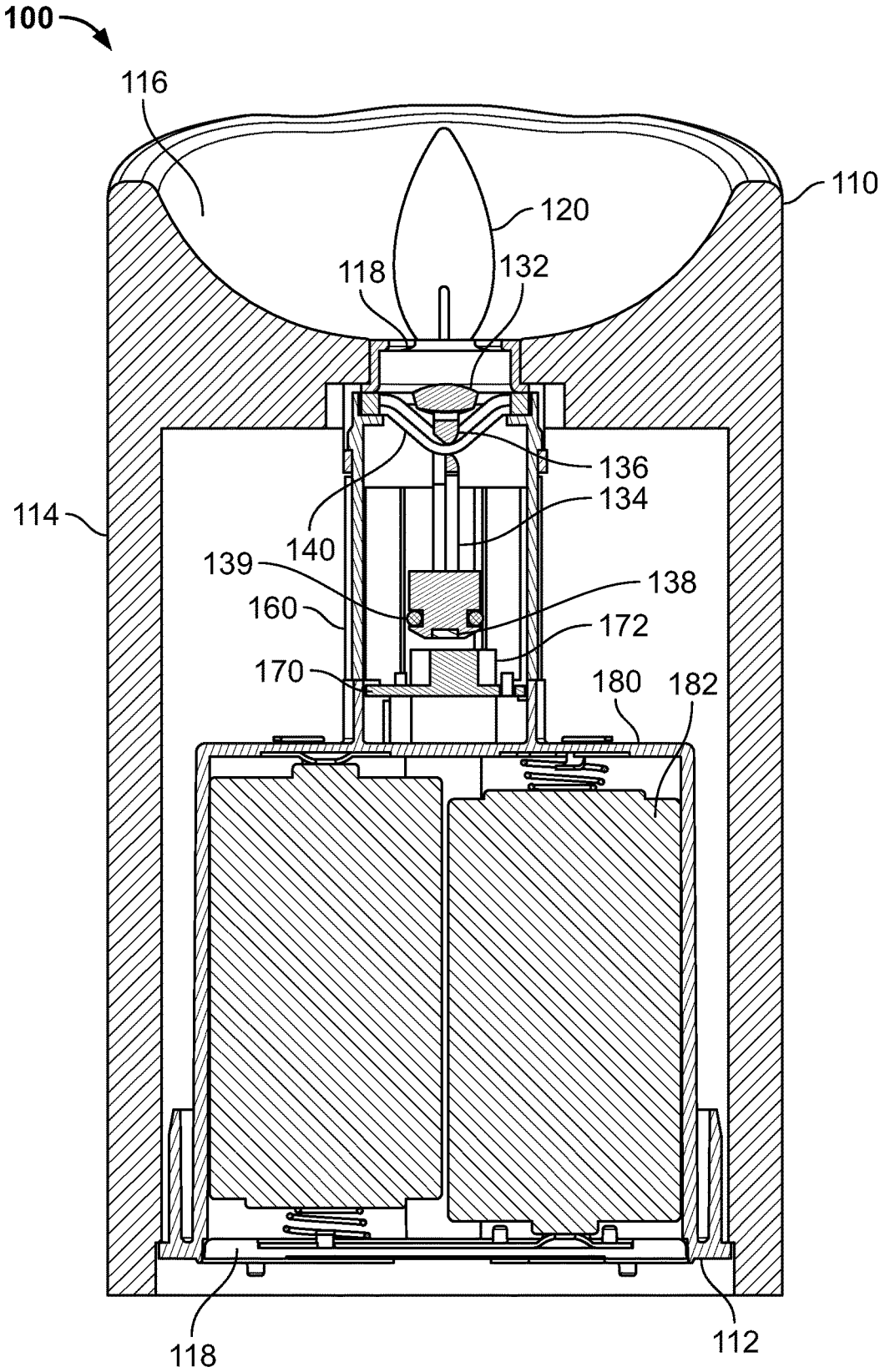
FIG. 5 illustrates a cross-sectional view of the flameless candle, according to certain inventive techniques.

The projection screen substructure 122 may be configured to be inserted into the aperture 118 of the upper surface 116 (for example, inserted from underneath the upper surface 116). For example, the projection screen substructure 112 may have a stair-step profile with a lower tier having a larger radius than an upper tier. The substructure 122 may have a generally circular profile (for example, the tier(s) may be generally circular) when viewed from above, or it may have other shapes such as ovate, square, rectangular, etc. The lower tier of the substructure 122 may act as a stop to prevent over-insertion of the substructure 122 into the aperture 118. The aperture 118 may have a stair-step profile complementary to that of the substructure 122 tiers, as shown in FIG. 3. This may facilitate accurate seating of the substructure 122 into the aperture 118. Once properly seated, the upper surface of the upper tier may be flush with or slightly below the upper surface 116. The substructure 122 may be secured to the candle body by friction fit, wax, mechanical means (for example, the substructure having anchoring portions that anchor into a waxen material on the candle body 110), or other epoxy.

The projection screen substructure 122 may have an aperture such that light projected from below can be projected onto the projection screen 120. As shown, the projection screen 120 is offset and positioned off of a primary axis along a vertical dimension at which the aperture 118 is located. Specifically, the projection screen 120 extends from an upper surface of an outer rim of the upper tier of the substructure 122. When the substructure is seated in the aperture 118, the light passing through the aperture of the substructure 122 also passes through the aperture 118 of the upper surface 116. The substructure 122 may have one or more engaging portions that engage with portions that generally are below the substructure 122. For example, as shown, the lower tier of the substructure 122 has two engaging portions (each having an aperture) that engages with complementary portions on the module housing 160 (for example, spring tabs as shown), such that the substructure 122 becomes a portion (for example, top portion) of the module 190.

The supporting portion 140 may support the moving portion 130, such that the moving portion can move in three dimensions. The supporting portion 140 may include a U-shape or V-shape region. The supporting portion 140 may nest in, be seated in, or connect to the module housing 160. As shown, the module housing 160 includes two slots that receive opposite ends of the supporting portion 140. The projection screen substructure 122 may secure the supporting portion 140 in the module housing 160 by forming a top to the receiving slots. The supporting portion 140 may be substantially rigid. It may include a tapered edge in all of or a portion of the top surface of the supporting portion 160. The tapered edge may come to a relatively sharp point. The moving portion 130 may rest on the top-surface tapered edge of the supporting portion 140. By having a tapered edge, freer movement of the moving portion 130 may be facilitated. For example, the tapered edge may allow for less friction and less interference with the moving portion 130. The tapered edge may permit at least three degrees of freedom of the moving portion 130. The region of the moving portion 130 that rests on the supporting portion 140 may also have a tapered edge (for example, tapered in the opposite direction, such that a wider region is higher than the narrower region that contacts the supporting portion).

The moving portion 130 may include a lens 132 and an arm 134. The moving portion 130 may optionally include an intermediate region 136 (for example, including an annular shaped region with an aperture as depicted) between the lens 132 and the arm 134 (or the lens 132 and arm 134 may be directly connected). The moving portion 130 may also include a magnet 138 seated, positioned, or located on the arm 134 (for example, a lower region of the arm 134). In this context, and as generally used herein, the word "on" is broadly understood to mean attached to, positioned on/in, located on/in, or the like. The moving portion may optionally include a bumper 139.

The lens 132 may include a transparent material such as acrylic. The lens 132 may have two or more surfaces (for example, a top surface and bottom surface as illustrated). The surfaces may include concave regions, convex regions (as shown for both surfaces), flat regions, or have an irregular surface (for example, a combination of concave, convex, and/or flat regions). When viewed from the top or bottom, the lens may have a substantially round shape, or other shapes are possible, such as ovate, square, or the like. The surfaces may touch each other, or may be separated by a lateral region (as depicted). When the moving portion 130 is in a resting position, the lens 132 may have a diagonal orientation (for example, 25 to 55 degrees with respect to a horizontal plane). According to one technique, the angle is approximately 40 degrees. Even when the lens 132 is moved to a maximum or minimum amount, it may still have a diagonal orientation (for example, 12 to 68 degrees). According to one technique, when the resting angle is approximately 40 degrees, the minimal angle is approximately 27 degrees and the maximal angle is approximately 53 degrees.

The arm 134 may extend generally downwardly, and it may be sized and arranged to act as a counterbalance to the lens 132 to maintain the lens 132 at a desired orientation when the moving portion 130 is in a resting position. The arm 134 may have an enlarged or heavier region towards the bottom. The arm 134 may have an area that accepts the magnet 138. For example, the arm 134 may have a recess on a bottom surface that is sized to receive the magnet 138. The magnet may be glued and/or press fit to the arm 134. The magnet 138 may include a material such as nickel or a nickel alloy.

The intermediate region 136 may abut the lens 132 and the arm 134. The intermediate region 136 may define an angle between the lens 132 and the arm 134, such as between 45 and 75 degrees (although this orientation may be achieved without the intermediate region 136). According to one technique, the intermediate region 136 may define an angle of approximately 60 degrees between the lens 132 and the arm 134. The intermediate region 136 may include a region that contacts the supporting portion 140. Such a region may include an aperture (for example, generally annular in shape, as shown) that substantially encircles the supporting portion 140. Such an arrangement may prevent the moving portion 130 from being constrained in movement by the supporting portion 140 (for example, prevents the moving portion from falling down or around or even coming out of the candle 100. There is no requirement, however, that the intermediate region 136 or the moving portion 130 have such an aperture. Other shapes for engaging the supporting portion 140 may be possible, such as an arch, a notch having an inverted V-shape (for example, a notch having a wider cut-out angle than the angle of taper on the upper surface of the supporting portion 140), or the like.

The bumper 139 may absorb impact of the moving portion if it comes in contact with other objects, such as the module housing 160. The bumper 139 may include a compressible material, such as rubber or ethylene propylene rubber. The bumper 139 may prevent a sound from being made when the moving portion 130 comes into contact with other objects. The bumper 139 may be located in a lower region of the moving portion 130, for example, on an enlarged region as shown in the figures. The bumper 139 may substantially or completely encompass such a region.

The light source 150 may include one or more light-emitting diodes (LEDs). The light source 150 may be selected to emit a color that resembles a color of a conventional candle flame. The lens 132 may also be colored to enhance or adjust the color of the projected light from the light source 150. For example, the lens 132 may include a colored region and an uncolored region (or it may be entirely colored or uncolored). In the example of a colored region, such a region may be blue in color (e.g., painted, printed, a sticker, colored epoxy, or the like). For example, areas on the rim of the lens 132 may be tinted or otherwise colored blue to cause the outer regions of the projected light to be bluish in color. When projected on the projection screen 120, this may enhance the illusion of a conventional candle flame.

The light source 150 may be arranged to generate a light having varying intensity (for example, to cause a flickering effect). The perceivable intensity of the light source 150 may vary by no more than ±25% of the average power as measured in lumens. By perceivable intensity, it is understood that this is the intensity recognizable by the human eye. The actual instantaneous power delivered to a light source 150 may be much more than 25%, such as for example by using pulse-width modulation techniques in which the power to a light source 150 is switched ON and OFF very rapidly.

The light source 150 may have a lens separate from lens 132. For example, the light source 150 may include a type of a conventional LED package that includes a lens where the light exits the package. The light source 150 may have an embedded circuit, such as one including a microprocessor and associated circuitry (e.g., an oscillator) that causes the flickering effect (or other effects, such as fade in/out, color changing, or the like). The light source 150 (independent of the lens 132 in the moving portion 130) may be configured to generate a beam of light having an associated beam-width—for example, a beam-width between 37 and 67 degrees. According to one technique, the beam-width is approximately 52 degrees.

The light source 150 may be mounted in the module housing 160. It may be secured, for example, with a light source securing portion 162. The light source 150 may be mounted at an angle, such as 50 to 80 degrees as measured from the horizontal plane. According to one technique, the light source is mounted at a 65 degree angle with respect to the horizontal plane. Such an angle may be measured from the horizontal plane to a central axis of the emitted beam of light. Thus, the light source 150 may be positioned to project light upwardly and diagonally, such that the light travels from the light source 150, through the lens 132, through the aperture 118 of the upper surface 116 of the candle body 110, and onto an outer surface of the projection screen 120. When viewed straight down from the top of the candle 100, the light source 150 and/or the lens 132 may not be visible through the aperture 118 (for example, these component(s) may not be located directly below the aperture. The light source 150 may be statically mounted as shown (i.e., the light source 150 does not move with respect to the candle body 110), or it may move (for example, vibrate or oscillate) by mechanical or electromagnetic means. The light source 150 and/or its package may be separated by a distance from the lens 132 (i.e., not abutting the lens 132).

A light pipe (for example, fiber optic or Lucite) may be used to provide flexibility in the positioning of the light source 150. The light pipe may receive light emitted from the light source 150 and project the light at an appropriate location. A prism may also be used to receive light projected from the light source 150 to alter the angle at which light is projected onto the projection screen 120. For example, a prism may bend light at a selected angle, such as 45 degrees.

The electromagnet 172 and control circuitry 170 may be positioned below the arm 134 of the moving portion 130, spaced by a distance. The electromagnet 172 may be driven by the control circuitry 170. The control circuitry 170 may also be electrically connected to the light source 150 and the user interface. The control circuitry 170 may be electrically connected or control and receive inputs from all electrical components in the candle 100. The control circuitry 170 may include a microprocessor that executes instructions to drive the electromagnet 172 and/or control the light source 150 in the specific manners described herein (for example, cause the light source 150 to flicker). The control circuitry 170 may also include other analog or digital components to control the operation of the candle 100, such as a state machine or oscillator to drive the electromagnet 172 and/or the light source 150. The control circuitry 170 may receive power from batteries 182.

The electromagnet 172 may include a wire coil. The coil may include wire or traces on a printed circuit board. The control circuitry 170 may alternately energize the electromagnet 172 positively (for example, a first polarity) and negatively (for example, a second polarity) such that it has alternating polarities over time. This may cause the electromagnet 172 to successively push (repel) and pull (attract) the magnet 138 over time, thereby causing the moving portion to move back and forth. The electromagnet 172 may be energized more than 50% of the time (either positively energized or negatively energized) when the moving portion 130 is in motion. The control circuitry 170 may include two or more modes (for example, the modes selectable through a user interface actuator like a switch or push-button) for driving the electromagnet 172. One mode may energize the electromagnet 172 to a lesser degree (less aggressive) and another mode may energize the electromagnet 172 to a greater degree (more aggressive). For example, the amount of current supplied to the electromagnet 172 by the control circuitry 170 may be smaller in the less aggressive mode and greater in the more aggressive mode. The amount of current supplied to the electromagnet 172 may vary gradually over time. For example, the amount of current supplied to the electromagnet 172 may be a sine wave over time—alternating between negative and positive currents to generate positive and negative magnetic polarities in the electromagnet 172.

A battery compartment 180 may house one or more batteries 182 (for example, two "C" batteries). A battery compartment door 118 may releasably engage with the base 112 to secure and allow access to the batteries 182 through one or more apertures in the base 112. The battery compartment 180 may be located below and may physically support the module 190 or components thereof.

A user interface may be accessible at or through the base 112. The user interface may include one or more actuators, such as switches, buttons, knobs, or other components. A user may interact with the interface to control the operation of the candle. The user interface may be electrically connected to the control circuitry 170 and/or the batteries. For example, an ON/OFF switch may disconnect power from reaching the control circuitry 170, or the status of such a switch may be sensed by the control circuitry 170 to cause it to shut down or restart operations of the candle 100. The user interface may include a timer control which is sensed by the control circuitry 170 to periodically shut down and restart (for example, 5 hours ON, and 19 hours OFF, or the like).

The user interface may include a control that adjusts the brightness or the flickering nature of the light source 150. The user interface may include a control that causes the color of the light source 150 to change—either to a new color statically, or by roaming through different colors (or ceasing roaming). The user interface may also include a control that adjusts, stops, or starts the movement of the moving portion 130 (for example, by adjusting the operation of the electromagnet 172 whereby the strength or pattern of energization may be altered). Generally, all of the features disclosed herein that relate to the operation of the candle 100 may be selectively activated, deactivated, or adjusted by interaction with components or actuators in the user interface. For example, if the candle 100 has a speaker and generates sound, the sound can be turned ON/OFF or the volume can be adjusted via user interface components(s). As another example, if the candle 100 includes a fan, user interface component(s) can cause the fan to turn ON/OFF and/or change the speed or direction of the fan. In addition to a user interface, some or all of the functionality disclosed herein can be affected through one or more wireless control modalities—for example, infrared, Bluetooth, WiFi, etc. A suitable remote would be able to send and/or receive signals through antenna(s) to control operations of the candle 100.

The candle 100 may operate in the following manner. A user may turn the candle 100 ON through a user interface positioned proximate the base 112. Energy may then flow to the control circuitry 170, which may then provide power to the electromagnet 172 and/or the light source 150. Alternately, light source 150 may receive power independently from the control circuitry 170. The light source 150 may be selectively energized such as to provide a flickering effect as discussed above.

Figure 6A:
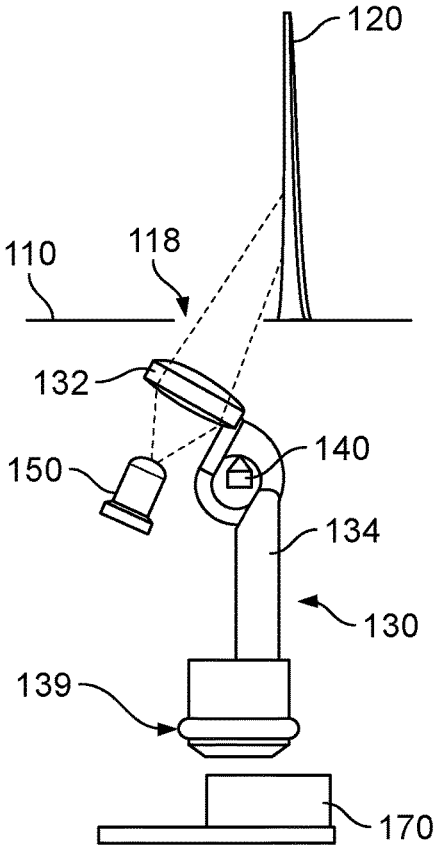
FIGS. 6A and 6B illustrate a moving lens altering a beam of light projected onto a projection screen, according to certain inventive techniques.
Figure 6B:
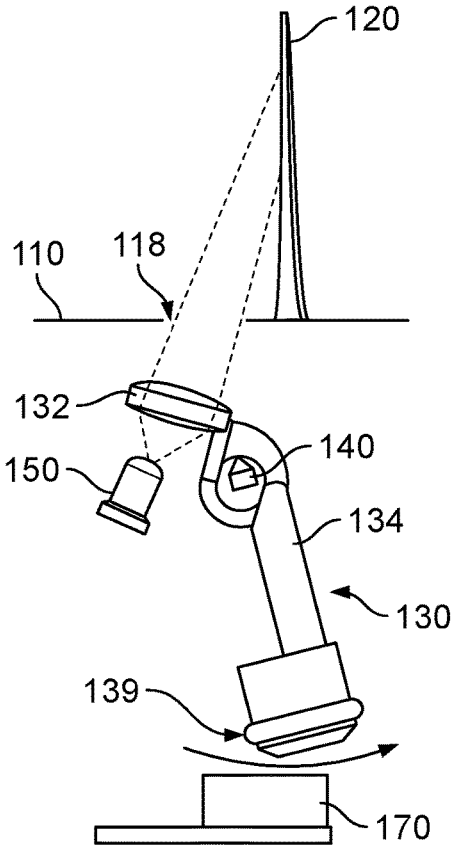

The energized light source 150 may emit a light beam having a central axis at an upward angle towards the projection screen 120. The angle may be 50 to 80 degrees as measured from the horizontal plane. According to one technique, the angle is 65 degrees with respect to the horizontal plane. The light travels from the light source 150, through the aperture 118 in the upper surface of the candle body 110, and onto the projection screen 120. The light beam may be refracted once or twice or even more times by the lens 132. As depicted, the light is refracted a first time when the light strikes the bottom surface of the lens 132 and a second time when the light strikes the top surface of the lens 132. The focal length of the altered light beam may vary as the moving portion 130 moves (thereby causing the distance and/or positioning between the light source 150 and the lens 132 to vary). This is depicted in FIGS. 6A and 6B. Both the position of altered light beam on the projection screen 120 and the focal length may be altered as the moving portion 130 moves. Specifically, when the moving portion 130 is in a first position, the altered light beam will project onto a first region of the external surface of the projection screen 120. It will have a first focal length. When the moving portion 130 is in a second position, the altered light beam will project onto a second region of the external surface of the projection screen 120, and the beam may have a second focal length different from the first focal length. First and second focal points defining the respective first and second focal lengths may be located beyond the projection screen 120. In other words, the projection screen 120 may intersect the light beam(s) before the focal point(s). The first and second regions may overlap or may be completely different. The regions on the projection screen 120 may vary in a vertical and/or horizontal dimension. The size of the regions may vary.

The control circuitry 170 may drive the electromagnet 172 by turning it ON and OFF and/or by reversing its polarity. According to one technique, polarity is successively reversed to push and pull the magnet 138 in the moving portion 130. The rate of pushing and pulling may be greater than the natural oscillation period of the moving portion 130. For example, the natural oscillation period of the moving portion 130 may be approximately 500 ms while the rate of push or pull may be between approximately 1-4 s. Thus, the ratio of push or pull time to the natural oscillation period may be between 2:1 and 8:1. The superposition of these two frequencies may result in a modulating beat that induces a substantially erratic movement to the lens 132. The duty cycle of the push/pull may be approximately 50% or may be set so the push or pull cycle is longer than the other one. The electromagnet 172 may be energized according to a predetermined or pseudorandom pattern and may be driven according to execution of a software program accordingly (for example, to cause pushing or pulling or to selectively energize and deenergize the electromagnet 172).

The push/pull caused by the electromagnet 172 may be achieved by driving the electromagnet 172 with a wave, such as a sine wave, a square wave, a sawtooth wave, or the like. It may be possible to have more complicated driving waves, such as waves that are a combination of a plurality of frequency sine wave components. By generating and combining multiple sine waves, it may be possible to generate a more complex, natural effect with multiple "beats" due to the phase characteristics of the multiple sine waves.

In addition to moving the illuminated region about on the projection screen 120, the light source 150 may also flicker as discussed. The degree of flickering, however, may be limited such that flickering is apparent through the translucent candle body 110, but not on the projected light on the projection screen 120. By limiting the apparent flickering power, this can be achieved. For example, by limiting the difference between maximum-to-average and minimum-to-average flickering by no more than approximately 25% as measured in lumens may achieve this effect. For the example of a relatively smaller candle (for example, 1.75" diameter), intensity may vary between approximately 0.9-1.5 lumens. For the example of a relatively larger candle (for example, 4" diameter), intensity may vary between approximately 2.6-4.4 lumens.

There may be more than one light source 150 (for example, ones with different colors, such as one that is blue and another that is yellow) and/or more than one moving lens 132 that operate in similar fashions. For example, there may be two light sources 150 and one lens 132. Light projected from one of these light sources 150 may be altered by the lens 132 and the other one may project directly onto the projection screen 120 without passing through a lens 132. As another example, both light sources 150 would project light through one lens 132 or through two respective lenses 132. According to yet another example, two or more lenses 132 may be arranged in series such that one beam of light passes through all of the lenses 132.

According to one technique, one light source 150 is positioned to project light onto a rear exterior surface of the projection screen 120 and another light source 150 is positioned to project light onto a front exterior surface of the projection screen 120. The light sources 150 may have different colors. The rearward light source 150 may project a blue light (either by virtue of being a blue LED, or by tinted lenses, coverings, etc.). The rearward light source 150 may project a non-moving beam of light onto the projection screen 120. The forward light source 150, by contrast, may project a light that is altered by a moving lens 132 as discussed above.

In addition to or in lieu of the electromagnet 172 and magnet 138 arrangement, the moving portion 130 may be driven by other mechanical means, such as, for example, driven air (a fan), a vibrating transducer, a spring, and/or one or more electric motors. Like the magnetic push/pull arrangement of the electromagnet 172 and magnet 138, motor(s) may physically push/pull the moving portion 130. Or such a motor arrangement may only push or pull the moving portion 130 and rely on its natural oscillation to fall back and move about. One technique for accomplishing motor-driven movement of the moving portion 130 is to have a motor shaft with a projection that contacts the moving portion 130. The shaft may rotate in one direction only, or may rotate both clockwise and counterclockwise. The projection would consequently push the moving portion 130 in only one direction when the shaft rotates in only one direction, or push the moving portion 130 in two directions when the shaft rotates both clockwise and counterclockwise.

According to another technique, several electromagnets (for example, at least three electromagnets) may be used to control the moving portion 130. The stator windings may generate a varying alternate magnetic field (for example, in response to being driven by a sine wave or a complex frequency with multiple sine wave components) to influence the magnet to make the arm move in multiple directions. Multiple outputs of a microprocessor or other suitable circuitry, for example, may be used for multiple H-bridge drivers to induce a variable-frequency alternating current into each of the motors' stator winding. The amplitudes of the movement in multiple directions may vary asynchronously, resulting in the induction of a variable beat (created by the combination of multiple frequencies). Such a frequency may be a lower frequency than the self-oscillating frequency of the moving portion 130. The lens 132 movements may be most of the time controlled by the servomotor driver and not by the self-oscillating period of the moving portion 130. The form of the shaft's bearings may also vary to provide an erratic movement.

According to other techniques, the candle 100 may play music and/or may be scented. The candle 100 may have a night-light actuator that, when actuated, causes the candle 100 to go into a low power mode, thereby emitting less light from the light source 150 than in the regular mode.

It will be understood by those skilled in the art that various changes may be made and equivalents may be substituted without departing from the scope of the novel techniques disclosed in this application. In addition, many modifications may be made to adapt a particular situation or material to the teachings of the novel techniques without departing from its scope. Therefore, it is intended that the novel techniques not be limited to the particular techniques disclosed, but that they will include all techniques falling within the scope of the appended claims.

The invention claimed is:

1. A flameless candle comprising:

a candle body including a base, an upper surface including an aperture, and a translucent sidewall extending between the base and the upper surface, wherein the candle body forms a hollow interior region;

a projection screen extending upwardly from the upper surface of the candle body, wherein:

the projection screen comprises a flame shape and has a fixed position with respect to the upper surface of the candle body; and at least a portion of the projection screen is spaced apart from the candle body;

a supporting portion located within the hollow interior region;

a moving portion located within the hollow interior region and supported by the supporting portion, wherein the moving portion includes:

a lens oriented diagonally along a vertical dimension, wherein the lens is transparent;

an arm extending downwardly; and a magnet on the arm;

a light-emitting diode (LED) located within the hollow interior region, wherein:

the LED is oriented to project light upwardly and diagonally such that the projected light travels from the LED, through the lens, through the aperture of the upper surface of the candle body, and onto an outer surface of the projection screen; and the LED is separated by a distance from the lens; and a circuit including a coil arranged to alternately generate a magnetic field having a first polarity and a magnetic field having a second polarity, such that the magnet in the moving portion is successively attracted to the coil and repelled by the coil.

2. The flameless candle of claim 1, wherein a top surface of the supporting portion comprises a tapered edge.

3. The flameless candle of claim 1, wherein the supporting portion comprises at least one of a U-shape region or a V-shape region.

4. The flameless candle of claim 1, wherein the projected light emitted by the LED varies in intensity over time, such that the projected light flickers.

5. The flameless candle of claim 4, wherein a power of the projected light varies by no more than approximately 25% from the average power as measured in lumens, such that the maximum power is no more than approximately 125% of the average power and the minimum power is no less than approximately 75% of the average power.

6. The flameless candle of claim 1, wherein the moving portion further comprises an intermediate portion connected to the lens and the arm, wherein the intermediate portion rests on the supporting portion.

7. The flameless candle of claim 1, further comprising a module housing positioned primarily within the hollow interior region, wherein the module housing houses the supporting portion, the moving portion, and the LED.

8. The flameless candle of claim 7, wherein the module housing houses the coil.

9. The flameless candle of claim 1, wherein the coil is arranged as one or more traces on a printed circuit board.

10. The flameless candle of claim 1, wherein an outer surface of the projection screen comprises a convex surface facing the projected light.

11. The flameless candle of claim 1, wherein an outer surface of the projection screen comprises a concave surface facing the projected light.

12. The flameless candle of claim 1, wherein an outer surface of the projection screen comprises an irregular surface facing the projected light with at least one concave region and at least one convex region.

13. The flameless candle of claim 1, wherein an outer surface of the projection screen comprises a flat surface facing the projected light.

14. The flameless candle of claim 1, wherein the lens comprises three degrees of freedom when the moving portion is supported by the supporting portion.

15. The flameless candle of claim 1, wherein the coil is energized more than 50% of the time when the moving portion is in motion.

16. The flameless candle of claim 1, wherein the projection screen comprises an appearance of a wick.

17. The flameless candle of claim 16, wherein the appearance of a wick comprises a hole in the projection screen.

18. The flameless candle of claim 1, wherein the moving portion further comprises a bumper.

19. The flameless candle of 1, wherein the lens comprises a colored region and an uncolored region.

20. The flameless candle of claim 19, wherein the colored region comprises a blue color.

* * * * *